US005718031A

United States Patent [19]

Seybold

[11] Patent Number: 5,718,031

[45] Date of Patent: Feb. 17, 1998

[54] METHOD FOR REINKER RESERVOIR PAD INSERTION

[75] Inventor: James M. Seybold, Centerville, Ohio

[73] Assignee: NCR Corporation, Dayton, Ohio

[21] Appl. No.: 791,942

[22] Filed: Jan. 31, 1997

[51] Int. Cl.[6] ..... B21D 39/03

[52] U.S. Cl. ..... 29/428; 29/806; 400/250; 400/247

[58] Field of Search ..... 400/250, 247, 400/692, 719; 29/806, 278, 270, 428

[56] References Cited

U.S. PATENT DOCUMENTS 2,178,346 10/1939 Mulch ..... 400/250

3,465,413 9/1969 Rosaen et al. ..... 29/428

4,255,779 3/1981 Meal ..... 361/308

5,052,143 10/1991 Ryan ..... 29/270

*Primary Examiner*—Edgar S. Burr

*Assistant Examiner*—Anthony H. Nguyen

*Attorney, Agent, or Firm*—Charlene Stukenborg

[57] ABSTRACT

A method for consistently inserting pads into ribbons cassettes and a plunger for performing such method are provided. The specially designed plunger insures each pad is subject to the same amount of compression upon insertion into the reinker housing walls of each ribbon cassette. Since each pad is subject to the same amount of compression, each pad consistently absorbs the same quantity of ink without pooling.

8 Claims, 2 Drawing Sheets

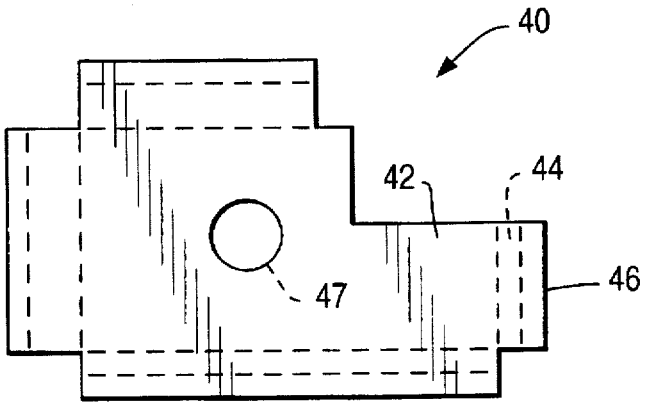
FIG. 2A
FIG. 2B
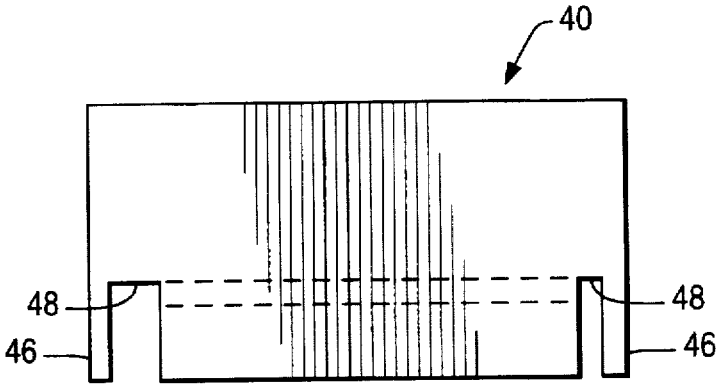
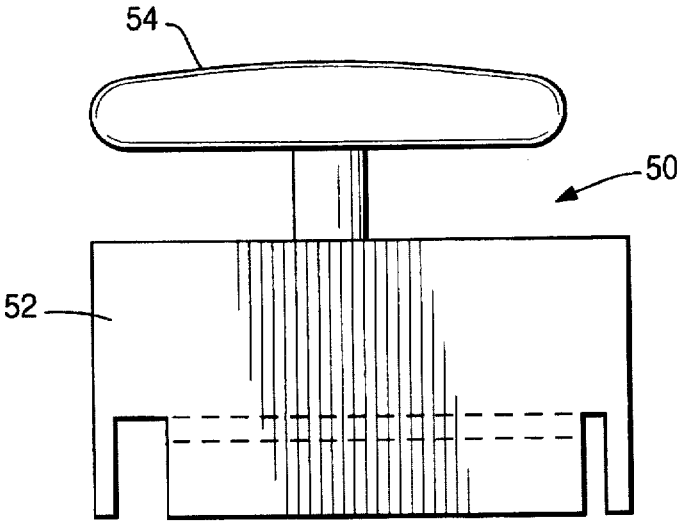
FIG. 3

METHOD FOR REINKER RESERVOIR PAD INSERTION

The present invention relates to a method for reinker reservoir pad insertion particularly in printing ribbon cassettes. A plunger for use with the method is also provided.

BACKGROUND OF THE INVENTION

Many inked ribbon cassettes include re-inking apparatuses for providing additional ink to the ribbon to extend the useful life of the cassette. Generally the reinker tank has a foam wick and a foe pad. The foam wick provides a means for transferring ink from the foam pad to a metering wheel, roller or other device which contacts the ribbon. To maintain contact with the foam wick, the space in the cassette for the pad is generally smaller than the actual size of the pad. Such a tight fit does not allow the pad to spring back if it is manually compressed more than is necessary as generally occurs when an operator manually inserts the foam pad into the reinker tank.

The foam pad is generally loaded with ink to near the saturation limit of the foam to maximize the life of the ribbon cassette. If the same amount of ink is loaded into two pads, the ink may be fully absorbed in one of the pads and a significant pool of ink may be left unabsorbed by the other pad. Unabsorbed ink is not desirable as it pools in the housing which contains the pad and may leak from the cassette. Although the pads inserted in a plurality of ribbon cassettes may be visually similar, some of the pads must be more compressed than others during insertion of the pads into the cassettes. The amount of ink that each foam pad can hold is dependent on how much the foam pad is compressed during insertion. Therefore each pad needs a controlled insertion which cannot be achieved via manual insertion by a human operator. Therefore, there is a need for a method and a plunger for consistently inserting pads into ribbon cassettes to achieve the desired results.

SUMMARY OF THE INVENTION

In accordance with the teachings of the present invention, a method for consistently inserting pads into ribbons cassettes and a plunger for use with such method are provided. The specially designed plunger insures each pad is subject to the same amount of compression upon insertion into the reinker housing walls of each ribbon cassette. Since each pad is subject to the same amount of compression, each pad consistently absorbs the same quantity of ink without pooling.

It is an object of the present invention to provide a method and a plunger for inserting pads into ribbon cassettes which does not leave unabsorbed ink in the reinker housing which may leak from a ribbon cassette.

It is another object of the present invention to provide a method and a plunger for inserting pads into ribbon cassettes which enables the maximum (near saturation) level of ink to be applied to each pad without ink pooling and leaking of any cassettes.

It is yet another object of the present invention to provide a method and a plunger for inserting pads into ribbon cassettes which causes each pad to be subject to the same amount of compression during insertion into the cassette.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

FIGS. 2A and 2B show a top view and a side view of the specially designed plunger used to insert the pad; and FIG. 3 shows another view of the specially designed plunger having a handle for an operator to use.

DETAILED DESCRIPTION

Figure 1:
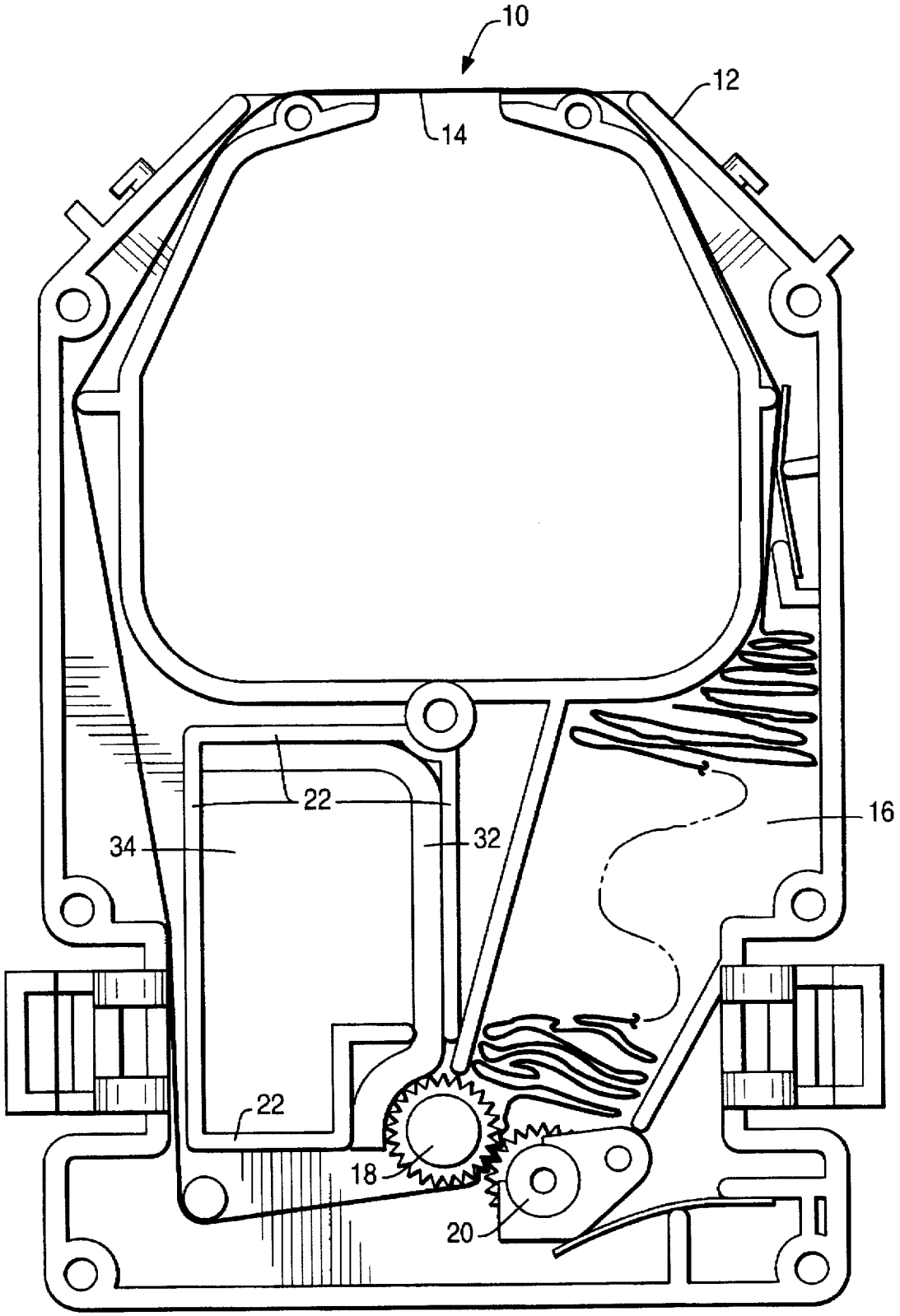
FIG. 1 shows a top view of an inked ribbon printer cassette including the pad inserted according to the method of the present invention.

Referring now to the drawings, in which like-referenced characters indicate corresponding elements throughout the several views, attention is first drawn to FIG. 1 which shows a top view of an inked ribbon printer cassette 10 having a pad inserted according to the method of the present invention. The inked ribbon printer cassette 10 shown is based on the NCR 7141 printer ribbon cassette and is used for example only. The present invention contemplates application to any cassette including a pad saturated with liquid ink or equivalents. The inked ribbon printer cassette 10 includes a housing 12, formed of ABS plastic, a synthetic resin plastic, or like material commonly used to mold housings for ribbon cassettes. Inked ribbon printer cassette 10 also includes a ribbon 14, preferably a nylon ribbon. The housing 12 of inked ribbon printer cassette 10 also includes a ribbon storage cavity 16 for storing the ribbon 14 until just before it is guided in front of a print head for operation. The housing 12 also includes a pair of rollers, drive roller 18 and idler roller 20, for guiding and re-inking the ribbon 14 before it is stored in the ribbon storage cavity 16. Drive roller 18 and idler roller 20 are preferably gears as are well-known in the art. The housing 12 also includes reinker housing walls 22. These walls are preferably molded with the rest of the housing.

The reinker includes a foam pad 34 and a wick 32. Foam pad 34 may be formed of any type of porous foam or any other type of porous material which can be impregnated with a liquid ink. The term wick 32 includes any ink applying member and may be formed of a porous foam, a porous felt or other porous material. Both the foam pad and a portion of the wick are contained by reinker housing walls 22.

FIG. 2A shows a top view and FIG. 2B shows a side view of the plunger used to insert the foam pad 34 into the ribbon cassette. The plunger is preferably formed of steel or other hardened materials which will maintain substantially the same dimensions over several uses. The plunger 40 includes a footprint 42 of the pad 34. The plunger footprint 42 is substantially the same size as the pad 34 and has a smooth surface to press evenly over the entire pad 34 to prevent unnecessary compression of the pad 34. The plunger 40 also includes a threaded screw hole 47 or equivalent means such as a hook, bolt, positioning hole, rod, etc. to enable attachment of means for the human operator to control or use the plunger. Outside the pad footprint 42, the plunger also includes a portion 44 which bottoms out at surfaces 48 on the reinker housing walls 22. The surfaces 48 provide a positive stop so the pad is fully inserted but not subject to any additional compression which would limit the amount of ink which can be held in the pad 34 and cause undesirable pooling. Additionally the plunger 40 includes guide walls 46 which align along the outer sides of the reinker housing walls 22. The above described configuration with the guide walls 46, pad footprint 42, and the positive stop surfaces 48 insure that each pad is compressed the same amount as other pads being inserted into other cassettes using the same method.

FIG. 3 shows a plunger assembly 50 including a plunger 52 with an attached handle 54 for an operator to use in placing and using the plunger according to the present invention.

According to the method of the present invention, the ribbon cassette 10 is assembled according to standard, well-known procedures with the exception of the incorporation of the specially designed plunger as described hereinafter. The operator initially or loosely places the pad 34 within the reinker housing walls without compressing the pad 34. After initially placing the pad into the reinker housing walls, the operator places the plunger 40 by aligning the plunger guide walls 46 outside the reinker housing walls 22. Because of the special design of the plunger 40, the plunger 40 bottoms out when the pad 34 is fully inserted. Then the operator causes the plunger 40 to be removed from the cassette while leaving the pad 34 firmly in place. Then ink is applied to the pad 34 as is standard. Of course, the present invention contemplates automation of any of the above steps as long as the plunger fully inserts the pad in the cassette.

The use of the specially designed plunger for fully inserting the pad into the reinker housing in the cassette insures that each pad is placed with the same amount of compression. This provides that the same amount of ink can be applied to each pad without concern that some of the ink will not be absorbed into the pad and instead pool in the tank and possibly leak from the cassette.

While the present invention is described in terms of a hand tool to be manually operated by a human operator, it is contemplated that the present invention can be incorporated into to a standard assembly tool or press. The plunger could include pneumatic, hydraulic, or a simple manual lever system to lower the plunger into the ribbon cassette for full insertion of the pad.

Advantageously, the apparatus of the present invention provides the ink pad in each cassette with the same quantity of ink which is all absorbed in each pad so each cassette has a consistent print quality.

Yet another advantage of the present invention is that the system of the present invention provides a very workable and inexpensive way to eliminate the problem of unabsorbed ink from leaking from the ribbon cassette.

Still another advantage of the present invention is that consistently inserted pads without additional compression are provided. Consistently inserted pads consistently absorb the same amount of ink without surface pooling, particularly when the amount of ink approaches the saturation limit of the pad.

Although the invention has been described with particular reference to certain preferred embodiments thereof, variations and modifications of the present invention can be effected within the spirit and scope of the following claims.

What is claimed is:

1. A method for inserting pads into ribbon cassettes including the steps of:

providing ribbon cassettes having pads initially inserted in reinker housing walls;

providing a plunger for fully inserting each pad with a predetermined amount of compression;

using the plunger to fully insert each pad, wherein bottoming out of the plunger indicates each pad is fully inserted; and removing the plunger from each ribbon cassette.

2. The method of claim 1 further including the step of:

applying a predetermined amount of ink to each pad, wherein no pooling of the ink occurs.

3. The method of claim 2 wherein the predetermined amount of ink is near the saturation limit of each pad in each ribbon cassette.

4. The method of claim 1 wherein the predetermined amount of compression is substantially the same for each pad in each ribbon cassette.

5. A method of providing ribbon cassettes having a consistent amount of ink in pads without pooling, comprising the steps of:

providing a plunger to insert each pad into each cassette; and using the plunger to insert each pad with a consistent amount of compression so that each pad can absorb the consistent amount of ink.

6. A plunger for inserting pads into ribbon cassettes, comprising:

a pad footprint which is substantially the same size as the pads being inserted into the ribbon cassettes;

at least one positive stop surface; and at least one guide wall which aligns the plunger within each ribbon cassette.

7. The plunger of claim 6 wherein the pad footprint is substantially smooth so pressure is provided substantially equally over the entire pad.

8. The plunger of claim 6 wherein the at least one positive stop surface bottoms out on reinker housing walls.

* * * * *